US006114639A

United States Patent [19]

Hall et al.

[11] Patent Number: 6,114,639

[45] **Date of Patent: *Sep. 5, 2000**

[54] CONFIGURABLE SWITCH

[75] Inventors: Jeffrey S. Hall, Winnebago; Mark A. Mantua; David E. Olsen, both of Freeport, all of Ill.

[73] Assignee: Honeywell International Inc., Morristown, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/106,573

[22] Filed: Jun. 29, 1998

[51] Int. Cl.[7] ..... H01H 13/12

[52] U.S. Cl. ..... 200/16 A; 200/280

[58] Field of Search ..... 200/280, 281, 200/243, 16 A

[56] References Cited

U.S. PATENT DOCUMENTS

| | | | |
|---|---|---|---|
| 2,106,581 | 1/1938 | Unwin | 200/16 A |
| 2,727,964 | 12/1955 | Krenke | 200/243 |
| 3,437,773 | 4/1969 | Koertge | 200/243 |
| 4,212,076 | 7/1980 | Taylor et al. | 200/280 |
| 4,276,458 | 6/1981 | Alter | 200/280 X |
| 4,306,123 | 12/1981 | Taylor | 200/280 X |
| 4,503,409 | 3/1985 | Lerude et al. | 200/280 X |
| 5,569,890 | 10/1996 | Olsen | 200/16 A |

*Primary Examiner*—Renee Luebke

*Attorney, Agent, or Firm*—Kris T. Frederick; Andrew A. Abeyta; Roland W. Norris

[57] ABSTRACT

A configurable switch having a base and interchangeable stationary contacts positioned in adjustable locations with respect to the base. A plunger is slidably mounted with respect to the base so that the plunger moves between a first position and a second position. One or more moveable contacts are mounted in a normally open position or a normally closed position. In the first position or the second position, the moveable contacts make contact and/or break contact with the stationary contacts depending upon the respective arrangements of the stationary contacts and the moveable contacts. Thus the configuration of a four-circuit switch can be altered with a minimum of different components to be, for example, a four normally closed circuit configuration, three normally closed and one normally open circuit configuration, two normally closed and two normally open circuit configuration, etc., with a minimum of expense or retooling.

16 Claims, 5 Drawing Sheets

CONFIGURABLE SWITCH

BACKGROUND OF THE INVENTION

1. Field of the Invention

This invention relates to a configurable switch having a configurable base and a configurable plunger, which together permit the adjustable arrangement of contacts into one of several switch configurations.

2. Description of Related Art

Industrial limit switches, such as global limit switches, safety interlocks, safety solenoid interlocks and cable pull limit switches, are used in a wide variety of industrial applications. Limit switches contain switches that are manufactured to suit the particular application.

Typically, switches used in these products are designed and manufactured for a particular contact arrangement. Such switches generally contain two or more circuits having one or more normally closed (NC) contacts and/or one or more normally open (NO) contacts. Conventional arrangements typically include one normally open/one normally closed, also called a "single pole" arrangement, or two normally open/two normally closed, also called a "double pole" arrangement. In recent years, two normally closed and three normally closed/one normally open contact arrangements have been developed. Traditionally, a separate switch design is required for each contact arrangement. Separate switch designs often require unique parts that are not interchangeable among separate designs. Therefore, four separate common switch designs typically require four sets of unique components.

Conventional industrial limit switches often require additional normally closed contacts for added redundancy. Limit switch applications often require at least three positively driven, normally closed contacts along with one normally open monitor circuit.

Conventional switch mechanisms used in typical industrial limit switches are: one normally open/one normally closed; two normally open/two normally closed and two normally closed contact arrangements. Typically, the only common component among the three most common switch mechanism contact arrangements is a terminal screw. Therefore, according to one manufacturer, approximately twenty-seven separate components are currently required to produce three different switches.

Olsen, U.S. Pat. No. 5,569,890, is an example of a double pole switch which has a typical housing and plunger arrangement. It would not be possible to construct a switch having an arrangement of four normally closed contacts from the same components used in the double pole arrangement taught by the Olsen patent.

In the drawings of the present application, FIG. 1 shows an assembled prior art switch 5, having two circuits, such as used in typical industrial limit switches. Switch 5 is arranged in a one normally open/one normally closed circuit configuration. Switch 5 has a single normally open circuit, shown near the bottom of FIG. 1. FIG. 1 shows switch 5 in a normal position, i.e., when switch 5 is at rest. In the normal position in the normally open circuit, there is no electrical contact between moveable contact 45' and stationary contact 30'. The normally closed circuit, shown near the top of FIG. 1, occurs in the normal position when a pair of moveable contacts 45' electrically contact a corresponding pair of stationary contacts 30'. When plunger 40' is depressed, the normally open circuit closes and the normally closed circuit opens. Switch 5 taught in FIG. 1 is not configurable into any other circuit configuration other than by removing or disconnecting one of the two circuits.

FIG. 2 shows a disassembled prior art two-circuit switch 6 used in typical industrial limit switches. Switch 6 shown in FIG. 2 is assembled to create a two normally closed circuit configuration. As shown, switch 6 includes: base 15', plunger 40', moveable contacts 45', return spring 55, stationary contacts 30' and 30", terminal screws 70' and cover 75'. Stationary contacts 30' and 30" slidably mount within bosses 17 molded within base 15'. In the normal position, both moveable contacts 45' electrically contact stationary contacts 30' to create two normally closed circuits within switch 6. Like switch 5 shown in FIG. 1, switch 6 shown in FIG. 2 is not configurable into any other circuit configuration other than by removing or disconnecting one of the two circuits.

FIG. 3 shows a disassembled, four-circuit, prior art switch 7 used in typical industrial limit switches. Switch 7 is assembled to create a two normally open/two normally closed circuit configuration. As shown, switch 7 includes base 15', plunger 40', plunger attachment 41, moveable contacts 45', return spring 55, stationary contacts 30', terminal screws 70', terminal nuts 71, spacers 60 and cover 75'. Stationary contacts 30' slidably mount within bosses 17 molded within base 15'. In the normal position, two moveable contacts 45' electrically contact two stationary contacts 30' to create two normally closed circuits within switch 7 and the two moveable contacts 45' are electrically spaced from stationary contacts 30' to create two normally open circuits within switch 7. Two styles of stationary contacts 30' and 30" are also required in switch 7. Like switch 5 shown in FIG. 1 and switch 6 shown in FIG. 2, switch 7 shown in FIG. 3 is not configurable into any other circuit configuration other than by removing or disconnecting one or more of the four circuits.

Other than terminal screws 70', the components used in prior art switches 5, 6, 7 are typically not interchangeable. Therefore, to assemble three separate conventional switches 5, 6, 7, each having different circuit configurations, requires at least twenty-seven unique components.

SUMMARY OF THE INVENTION

It is one object of this invention to provide a configurable switch that can be configured in any one of several different contact arrangements.

It is another object of this invention to provide a configurable switch that is manufactured with common components adjusted into different configurations.

It is another object of this invention to provide a configurable switch that contains a configurable plunger accommodating multiple moveable arrangements.

It is another object of this invention to provide a configurable switch that contains a configurable base accommodating multiple stationary contact arrangements.

It is still another object of this invention to provide a configurable switch that reduces manufacturing costs by using one or more identical components to manufacture a functional variety of switches.

It is yet another object of this invention to provide a configurable switch that provides a break-before-make contact condition to ensure that the normally closed contact is positively broken before a normally open contact is closed.

Conventional switches require components that are typically not interchangeable, therefore requiring many separate components to assemble a functional variety of switches having different circuit configurations. A configurable switch according to this invention preferably comprises a single set of components to assemble a switch capable of accommodating any one of many separate circuit configurations.

A configurable switch according to this invention preferably comprises a base, such as a configurable base, having a plurality of pairs of openings. Preferably, the configurable switch has two pairs of openings for every circuit accommodated by the configurable switch.

Stationary contacts are connected to the base preferably so that at least a portion of each stationary contact is positioned within one opening of each pair of openings. Each stationary contact preferably comprises a contact leg and a conductive contact pad. Each stationary contact is preferably interchangeable between both openings of each of the pairs of openings. Therefore, the base is configurable to permit multiple arrangements of stationary contacts within the openings.

A plunger, such as a configurable plunger, is preferably slidably mounted with respect to the base. The plunger is moveable with respect to the base between a first position and a second position. A bias element, such as a spring, preferably but not necessarily urges the plunger into the first position when the switch is at rest.

The plunger adjustably accepts at least one moveable contact preferably comprising two contact pads spaced at a distance from each other and connected by a contact bracket. The moveable contacts are preferably adjustably mounted in either a normally open position or a normally closed position with respect to the plunger and the stationary contacts. Preferably, a bias element is positioned within the opening of the plunger to bias the moveable contacts into position against a surface of the plunger. The bias element in this position results in a break-before-make contact device.

In an assembled configurable switch of this invention, the moveable contacts electrically contact the stationary contacts in either the first position or the second position of the plunger. The configurable switch is preferably capable of configuration so that the stationary contacts and the moveable contacts may be arranged to create one of at least the following configurations: (a) a configurable switch having four normally open circuits; (b) a configurable switch having four normally closed circuits; (c) four different switch configurations having three normally open circuits and one normally closed circuit; (d) four different switch configurations having three normally closed circuits and one normally open circuit; or (e) six different switch configurations having two normally open circuits and two normally closed circuits. A configurable switch according to this invention can also have more than four circuits or less than four circuits.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
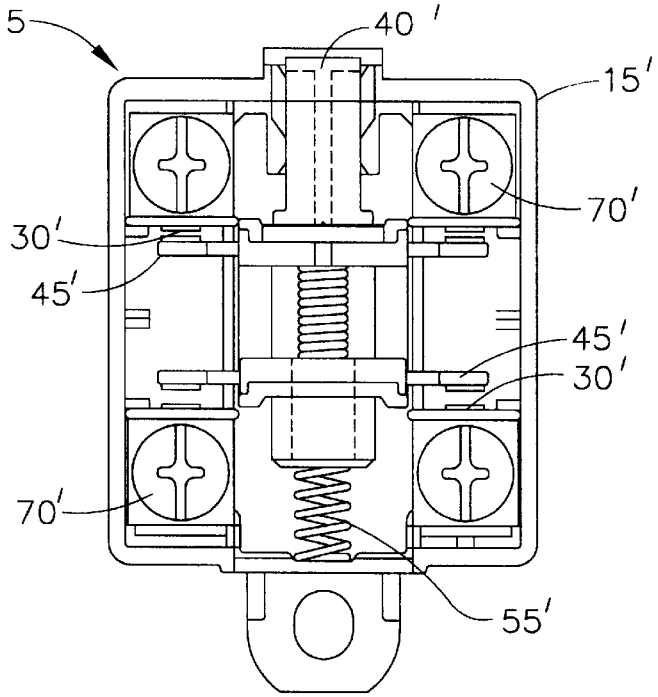
FIG. 1 (PRIOR ART)
FIG. 1 is a front view of a switch according to the prior art.
Figure 2:
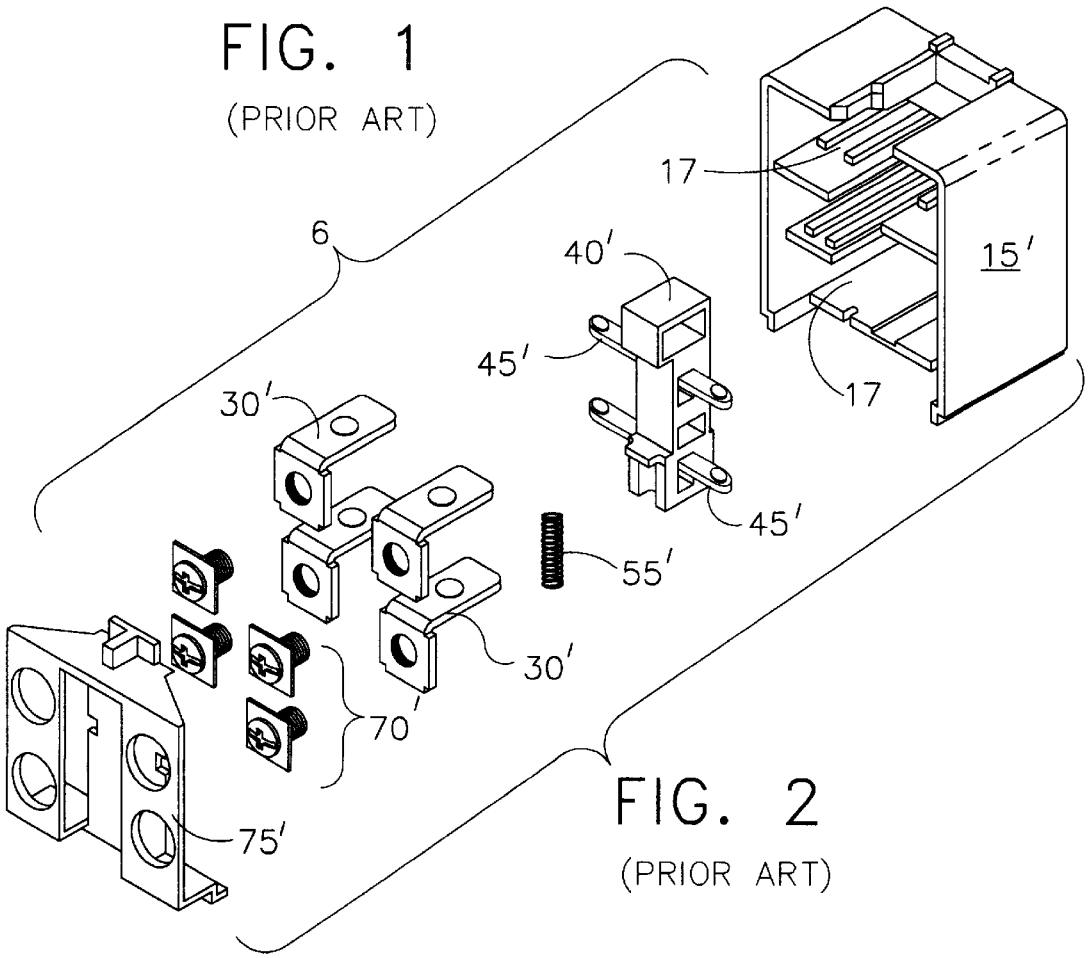
FIG. 2 (PRIOR ART)
FIG. 2 is an exploded perspective view of a switch according to the prior art.
Figure 3:
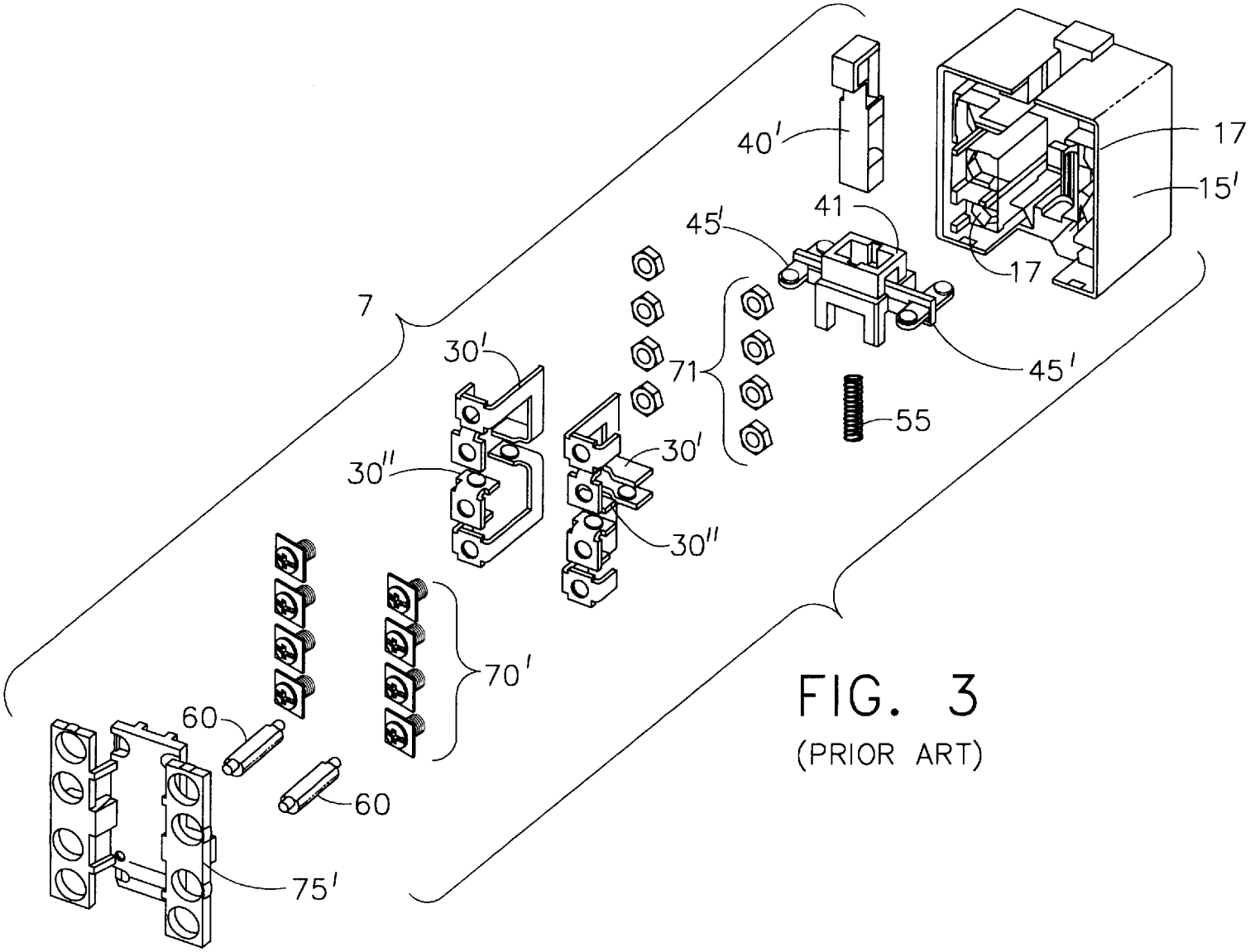
FIG. 3 (PRIOR ART)
FIG. 3 is an exploded perspective view of a switch according to the prior art.
Figure 4:
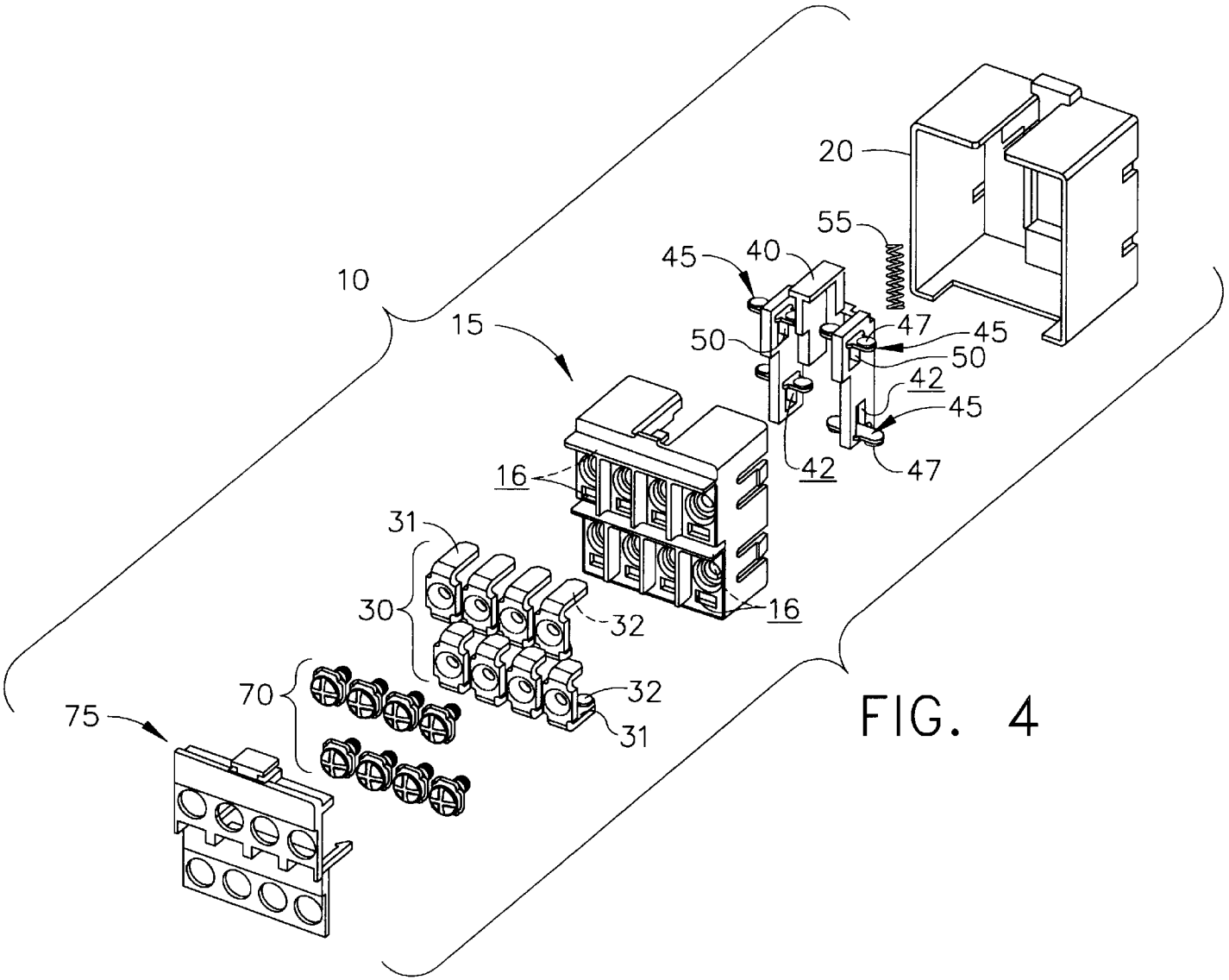
FIG. 4 is an exploded perspective view of a configurable switch, according to one preferred embodiment of this invention.
Figure 5:
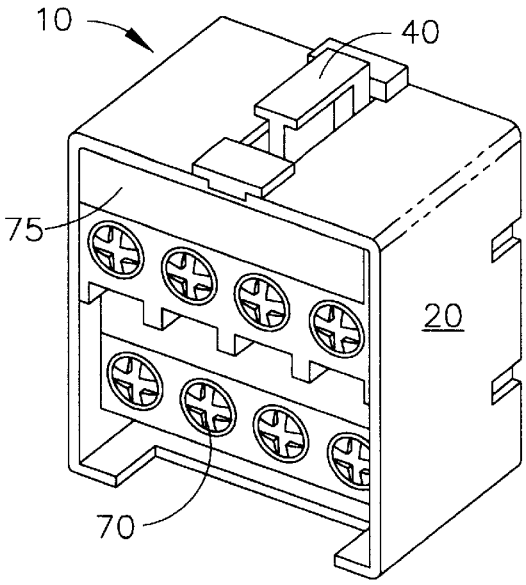
FIG. 5 is a perspective view of the configurable switch shown in FIG. 4.

FIG. 4 shows a disassembled configurable switch 10 according to one preferred embodiment of this invention. FIG. 5 shows configurable switch 10 in assembled form. As shown in FIG. 4, configurable switch 10 comprises a four-circuit arrangement having only nine unique components. The particular configuration shown in FIG. 4 is a three normally closed/one normally open circuit configuration.

Base 15 shown in FIG. 4, is preferably constructed from a molded non-conductive, thermoplastic material. The thermoplastic material preferably is sufficiently durable to endure up to at least 15 million cycles and operating temperatures between about −25° C. and about 85° C. The thermoplastic material should also have sufficient flexibility to permit snap fitting among multiple thermoplastic components within configurable switch 10.

Figure 6:
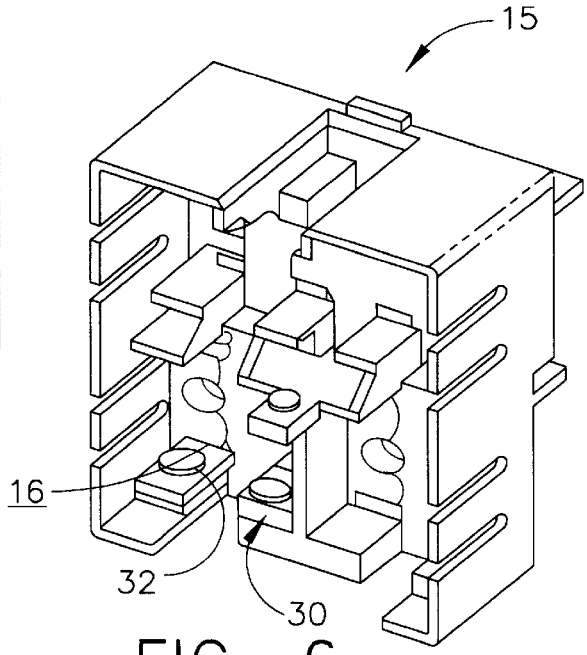
FIG. 6 is a rear perspective view of a base shown in FIG. 4.
Figure 7:
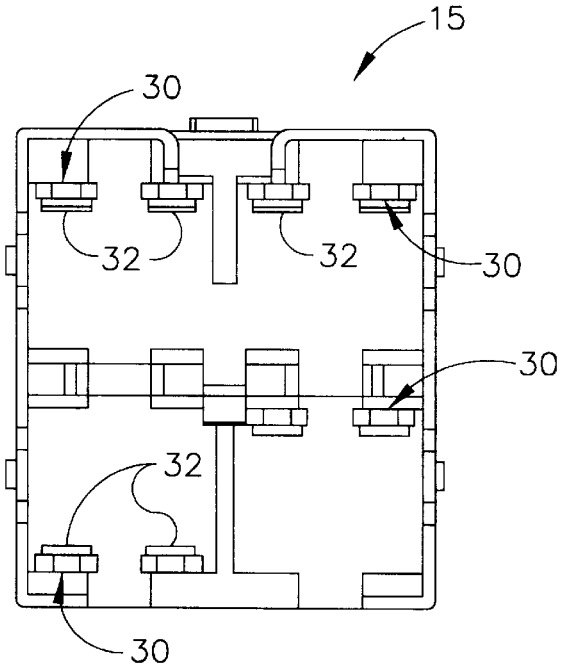
FIG. 7 is a rear view of a base shown in FIG. 4.

In one preferred embodiment of this invention, shown in FIGS. 4, 6 and 7, base 15 contains a plurality of pairs of openings 16. Pairs of openings 16 are preferably positioned generally opposite each other and integrally molded within base 15. Preferably, two pairs of openings 16 correspond to each circuit in configurable switch 10. In the preferred embodiment of the invention shown in FIGS. 4, 6 and 7, configurable switch 10 accommodates four circuits and therefore has eight pairs of openings 16.

Figure 8:
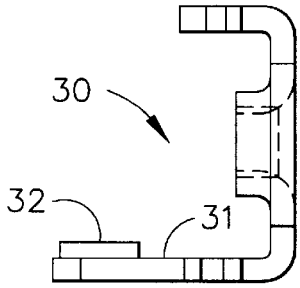
FIG. 8 is a side view of a stationary contact, according to one preferred embodiment of this invention.
Figure 9:
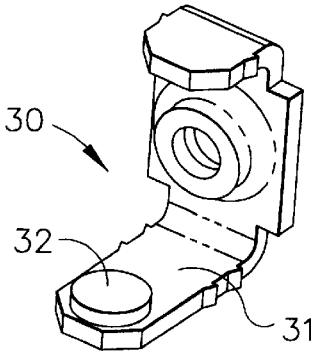
FIG. 9 is a front perspective view of a stationary contact shown in FIG. 8.

As shown in FIGS. 4 and 6–9, at least one pair of stationary contacts 30 are preferably mounted within a corresponding pair of openings 16 and connected to base 15. In one preferred embodiment of this invention, stationary contact 30 comprises contact leg 31 and contact pad 32, as best shown in FIGS. 8 and 9. Preferably, contact leg 31 comprises an appropriate means for mounting stationary contact 30 to base 15. On one preferred embodiment, contact pad 32 is a welded fine silver disk attached directly to or fixed with respect to stationary contact 30. It is apparent that contact pad 32 may comprise any other material or composite material having conductive properties, such as suitable materials and composite materials known to those skilled in the art.

According to one preferred embodiment of this invention, shown in FIGS. 4 and 6–9, each stationary contact 30 has one contact leg 31 mounted within one opening 16 of a corresponding pair of openings 16 within base 15. Contact leg 31 is preferably interchangeable between both openings 16 of each of the pairs of openings 16. Therefore, base 15 is configurable to accommodate any feasible arrangement of stationary contacts 30 within openings 16. As used throughout this specification and in the claims, the term configurable base is intended to relate at least to the interchangeability of stationary contacts 30 within base 15 as well as any other suitable structure that allows adjustable positioning of stationary contacts 30 with respect to base 15. In one preferred embodiment of this invention, adjacent pairs of stationary contacts 30 are positioned within adjacent openings of the pairs of openings 16.

According to one preferred embodiment of this invention, each stationary contact 30 is interference fitted into base 15. In the preferred embodiment of this invention shown in FIG. 4, stationary contacts 30 are press fitted into base 15. An interference fit or press fit permits installation of stationary contacts 30 in base 15 without additional fastening means or special tools or equipment. Alternatively, stationary contacts 30 may be sonic welded with respect to base 15, adhered with respect to base 15, insert molded with respect to base 15 or joined with base 15 using any other fastening method known to those having ordinary skill in the art.

As shown in FIGS. 4 and 5, plunger 40 is slidably mounted with respect to base 15. Plunger 40 is preferably constructed from the same or similar material as base 15. Plunger 40 is moveable with respect to base 15 between a first position and a second position. The first position preferably comprises the normal position, or the at rest position, of configurable switch 10. The second position preferably comprises an engaged position, or active position, of configurable switch 10.

A bias element such as return spring 55 preferably urges plunger 40 into the first position or the second position. In one preferred embodiment of this invention, return spring 55 is positioned between a portion of base 15 and a portion of plunger 40 to urge plunger 40 into the first position when configurable switch 10 is at rest.

As shown in FIG. 4, plunger 40 contains one or more moveable contacts 45. Moveable contacts 45 are constructed from a conductive material and each preferably comprises two contact pads 47 spaced at a distance from each other and connected by contact bracket 46. Contact pads 47 each is preferably a fine silver disk or another suitable conductive material disk welded or otherwise attached to moveable contact 45. Moveable contacts 45 are preferably adjustably positioned or mounted in either a normally open position or a normally closed position. As shown in FIG. 4, with stationary contacts 30 positioned as shown, three moveable contacts 45 are positioned in a normally closed position and one moveable contact 45 is positioned in a normally open position. As used throughout this specification and in the claims, the term configurable plunger is intended to relate at least to the interchangeability of moveable contacts 45 within plunger 40, such as between the normally open position and the normally closed position, as well as any other suitable structure that allows adjustable positioning of moveable contacts 45 with respect to plunger 40.

Figure 11:
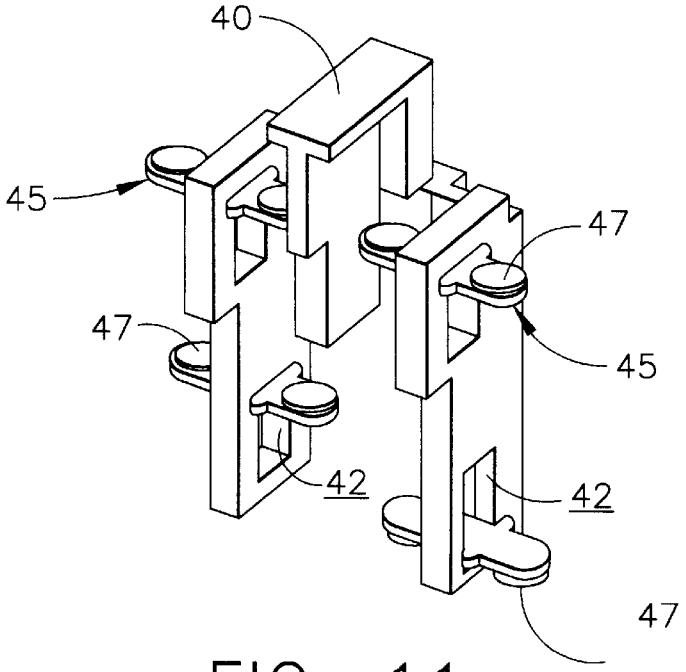
FIG. 11 is a perspective view of a plunger shown in FIG. 4.

FIG. 11 shows an enlarged view of one preferred embodiment of plunger 40. As shown in FIG. 11, plunger 40 has at least one and preferably a plurality of openings 42. As shown in FIG. 11, plunger 40 may comprise four longitudinal openings 42 or channels, such as within side legs of plunger 40. At least one moveable contact 45 is mounted within at least one opening 42. Moveable contacts 45 positioned in an upper position, upper relative to the position shown in FIG. 11, of opening 42 with contact pads 47 facing an upper portion of plunger 40 are positioned in the normally closed position, when stationary contacts 32 are positioned as shown in FIG. 4. Moveable contacts 45 in FIG. 11 positioned in a lower position of opening 42 with contact pads 47 facing a lower portion of plunger 40 are positioned in the normally open position.

Figure 12:
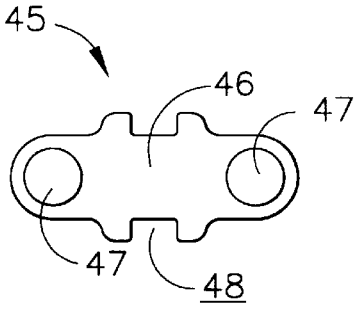
FIG. 12 is a top view of a moveable contact, according to one preferred embodiment of this invention.

FIG. 12 shows an enlarged top view of moveable contact 45. In addition to contact pads 47 and contact bracket 46, moveable contact 45 preferably comprises cutout 48 in an edge portion of contact bracket 46. Cutout 48 permits contact bracket 46 to closely engage with opening 42 in plunger 40 and thus restrict unwanted movement of moveable contact 45 within plunger 40.

Preferably, a bias element such as contact spring 50 is positioned within each opening 42 to bias moveable contact 45 toward a stop or an edge surface of plunger 40 adjacent opening 42. The bias element, such as contact spring 50, creates a break-before-make contact device. A break-before-make contact device ensures that normally closed contacts are positively broken, or opened, before normally open contacts are closed. In alternative preferred embodiments of this invention, depending upon the required application, configurable switch 10 may be a make-before-break contact device or simultaneous make and break contact device.

In an assembled configurable switch 10, shown in one preferred embodiment in FIG. 5, moveable contacts 45 electrically contact stationary contacts 30 in the first position and/or the second position of plunger 40. Preferably, moveable contacts 45 electrically make contact with corresponding stationary contacts 30 in normally closed circuits in the first position and break contact in the second position. Likewise, moveable contacts 45 do not electrically contact stationary contacts 30 in normally open circuits in the first position and make contact in the second position.

According to one preferred embodiment of this invention, shown in FIG. 4, configurable switch 10 further comprises case 20 which encloses base 15 and preferably a portion of plunger 40. Case 20 is preferably but not necessarily the same material as base 15 and plunger 40. For manufacturing simplicity, case 20 is preferably free of bosses and other functional internal structural features for mounting contact hardware. Case 20 also preferably comprises the same profile, or "footprint," of conventional switches for compatibility and interchangeability with such conventional switches. Case 20 is also preferably snap fitted with base 15 to ease assembly.

As shown in FIG. 4, configurable switch 10 also preferably comprises terminal screws 70 for securing circuit wires to configurable switch 10 and cover 75. Cover 75 is preferably but not necessarily the same material as base 15, case 20 and the other nonconductive elements of configurable switch 10. Cover 75, like the other molded components, preferably is snap fitted with base 15 or another component of configurable switch 10.

In one preferred embodiment of this invention, configurable switch 10, shown in FIGS. 4–7, is preferably capable of configuration so that stationary contacts 30 and moveable contacts 45 may be arranged to create at least the following configurations: (a) one configurable switch accommodating four normally open circuits; (b) one configurable switch accommodating four normally closed circuits; (c) four different switch configurations accommodating three normally open circuits and one normally closed circuit; (d) four different switch configurations accommodating three normally closed circuits and one normally open circuit; or (e) six different switch configurations accommodating two normally open circuits and two normally closed circuits. Configurable switch 10 should also be capable of arrangement in one-circuit, two-circuit or three-circuit configurations by removing or disconnecting various circuits. Each of the above circuit configurations is relevant to the four-circuit configurable switch 10 shown in FIGS. 4–6.

Figure 10:
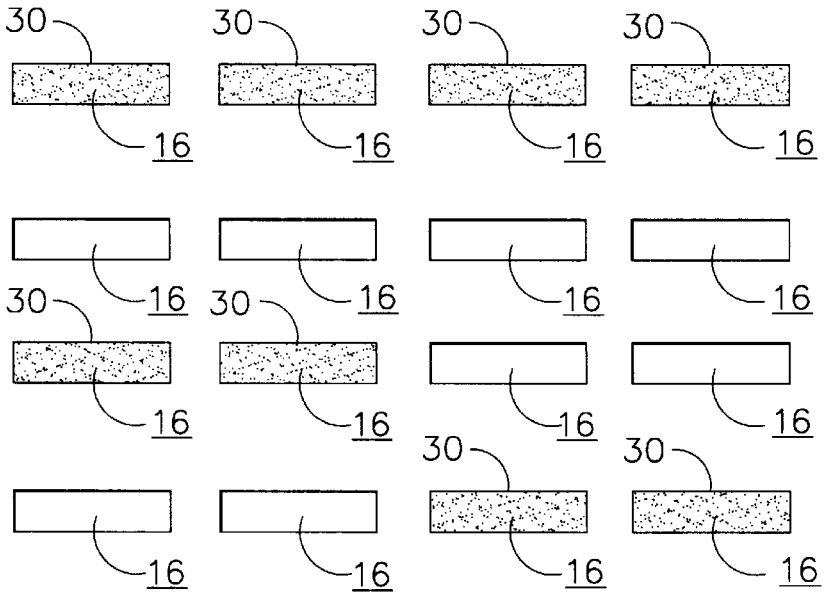
FIG. 10 is a diagrammatic view showing a layout of openings of the base and the position of contact legs of stationary contacts, according to one preferred embodiment of this invention.

FIG. 10 shows a diagrammatic layout of openings 16 according to the preferred embodiment shown in FIG. 4. The blackened rectangles represent the particular openings 16 in which contact legs 31 each having contact pad 32 are positioned. In the normal position of configurable switch 10, return spring 55 urges plunger 40 upward, relative to the orientation shown in FIGS. 4 and 9, and in such normal position moveable contacts 45 contact the upper left, the upper right and the lower left pairs of stationary contacts 30 but do not contact the lower right pair of stationary contacts 30. When plunger 40 is depressed or acted against the bias force of return spring 55 and moves out of the normal position, for example to the second position, contact is broken between moveable contacts 45 and the upper left, the upper right and the lower left pairs of stationary contacts 30 and contact is made between moveable contact 45 and the lower right pair of stationary contacts 30.

It is apparent that FIG. 10 represents only one possible configuration of many different configurations of openings 16 and/or stationary contacts 30 available with configurable switch 10 according to this invention. It is also apparent that the overall shape and/or cross-sectional shape of the elements of this invention can be different than as shown in FIGS. 4–12, without departing from the desired results of this invention. For example, the cross-sectional shapes of contact leg 31 and opening 16 can be rectangular as shown in FIGS. 4 and 8–10, or can be circular, oval, square, polygonal or any other suitable shape. Also as an example, contact pads 47 can have an overall circular shape as shown in FIG. 12, a square shape or any other suitable shape that promotes electrical contact between moveable contacts 45 and stationary contacts 30, for the desired application.

It should be noted that all normally closed circuits according to the preferred embodiment, regardless of position or quantity, are positively driven. This is important to ensure that, in the event of undesirable welding between the contacts, the circuit is mechanically broken, rather than conventionally relying on a bias element alone, such as snap-action springs, to create a break. Springs may fracture during the life of conventional switches, such as a snap-action switch, rendering the normally closed circuit inoperable and unable to be broken. Therefore, positively driven normally closed circuits are crucial in safety switch applications. Positively driven normally closed circuits also provide a break-before-make contact condition. This ensures that in a safety application, the normally closed contact is positively broken before a signal from the normally open contact is sent back to the monitor circuit, such as a programmable logic controller.

While in the foregoing specification this invention has been described in relation to certain preferred embodiments thereof, and many details have been set forth for purpose of illustration, it will be apparent to those skilled in the art that the configurable switch is susceptible to additional embodiments and that certain of the details described herein can be varied considerably without departing from the basic principles of this invention.

We claim:

1. A configurable switch comprising:

a base having a plurality of pairs of openings;

at least two pairs of stationary contacts connected to the base, each stationary contact having a contact leg mounted within one opening of the pairs of openings;

a plunger slidably mounted with respect to the base, the plunger moveable between a first position and a second position;

at least two moveable contacts mounted in one of a selectable normally open position and a selectable normally closed position with respect to the stationary contacts, the at least two moveable contacts contacting the stationary contacts in one of the plunger first and second positions;

wherein one of the at least two moveable contacts may be separately positioned in either the normally open or normally closed position regardless of the position of another moveable contact.

2. A configurable switch according to claim 1 wherein the base has eight pairs of openings.

3. A configurable switch according to claim 1 wherein each of the stationary contacts is interference fitted into the base.

4. A configurable switch according to claim 1 further comprising a bias element urging the plunger into one of the first position and the second position.

5. A configurable switch according to claim 1 wherein the plunger has at least one opening extending therethrough and at least one moveable contact is selectably positioned within the at least one opening in the plunger.

6. A configurable switch according to claim 5 further comprising at least one bias element urging at least one moveable contact into the selected position.

7. A configurable switch according to claim 5 wherein the plunger has four openings.

8. A configurable switch according to claim 1 wherein the stationary contacts and at least one moveable contact are arranged in a configuration selected from the group consisting of: a switch having four normally open circuits; a switch having four normally closed circuits; four different configurations having three normally open circuits and one normally closed circuit; four different configurations having three normally closed circuits and one normally open circuit; and six different configurations having two normally open circuits and two normally closed circuits.

9. A configurable switch according to claim 1 further comprising a case enclosing the base and at least a portion of the plunger.

10. A configurable switch according to claim 1 wherein at least one moveable contact comprises a pair of contact pads.

11. A configurable switch comprising:

a base having a plurality of pairs of holes extending therethrough;

at least two pairs of stationary contacts adjustably mounted with respect to the base in one of a normally open position and a normally closed position, each stationary contact having a contact leg mounted through one hole of each of the pairs of holes;

a plunger slidably mounted with respect to the base, the plunger moveable between a first position and a second position;

at least two moveable contacts connected to the plunger in a selected position and arranged such that in one of the first position and the second position at least one moveable contact contacts the stationary contacts; and wherein each stationary contact is interchangeably connectable between either of each of the pairs of holes.

12. A configurable switch according to claim 11 wherein the plunger has at least one opening, and wherein the at least two moveable contacts are mounted within each of the at least one opening.

13. A configurable switch according to claim 11 further comprising at least one bias element urging at least one moveable contact into the selected position.

14. A configurable switch according to claim 11 further comprising a bias element urging the plunger into one of the first position and the second position.

15. A configurable switch comprising:

a configurable base having a plurality of pairs of openings;

a plurality of stationary contacts each one stationary contact having a contact leg mounted within only one opening of each of the pairs of openings and interchangeable between both opening of each of the pairs of openings;

a configurable plunger moveably mounted with respect to the configurable base, said plunger having at least one opening;

at least one moveable contact adjustably mounted within the at least one plunger opening in one of a normally open position and a normally closed position with respect to the stationary contacts; and wherein the stationary contacts and at least one moveable contact are arranged in a configuration selected from the group consisting of: a switch having four normally open circuits; a switch having four normally closed circuits; four different configurations having three normally open circuits and one normally closed circuit; four different configurations having three normally closed circuits and one normally open circuit; and six different configurations having two normally open circuits and two normally closed circuits.

16. A The configurable switch of claim 15 further comprising at least one bias element urging the at least one moveable contact into contact with the stationary contacts.

* * * * *